US007681373B2

(12) United States Patent
Kariakin

(10) Patent No.: US 7,681,373 B2
(45) Date of Patent: Mar. 23, 2010

(54) STRUCTURAL SUPPORT FOR MANUFACTURED HOUSING TYPE STRUCTURES

(76) Inventor: Joseph Kariakin, 251 Sunset Ave. N., Keizer, OR (US) 97303

( * ) Notice: Subject to any disclaimer, the term of this patent is extended or adjusted under 35 U.S.C. 154(b) by 0 days.

(21) Appl. No.: 11/825,565

(22) Filed: Jul. 5, 2007

(65) Prior Publication Data

US 2008/0034689 A1 Feb. 14, 2008

Related U.S. Application Data

(60) Provisional application No. 60/821,896, filed on Aug. 9, 2006.

(51) Int. Cl.
*E04B 1/00* (2006.01)
*E02D 27/00* (2006.01)

(52) U.S. Cl. ..... 52/745.11; 52/741.1; 52/293.3; 52/274; 52/284; 52/294

(58) Field of Classification Search ..... 52/745.11, 52/741.1, 293.3, 274, 284, 791.13, 791.41, 52/DIG. 11, 294
See application file for complete search history.

(56) References Cited

U.S. PATENT DOCUMENTS 2,499,498 A * 3/1950 Hammond, Jr. ..... 52/67
5,067,289 A * 11/1991 Ouderkirk et al. ..... 52/169.11
5,359,816 A * 11/1994 Iacouides ..... 52/274
5,758,463 A * 6/1998 Mancini, Jr. ..... 52/309.12
6,276,096 B1 * 8/2001 Fair ..... 52/101
6,488,762 B1 * 12/2002 Shi ..... 106/676
6,550,191 B2 * 4/2003 Hoffmann et al. ..... 52/173.2
7,165,370 B1 * 1/2007 Wolfe ..... 52/589.1
2003/0226326 A1 * 12/2003 Sanger ..... 52/285.1

OTHER PUBLICATIONS

Schriever, W.R. CBD-188. Wind Forces on Mobile Homes. Canadian Building Digest. Published Jun. 1977.*

* cited by examiner

*Primary Examiner*—Richard E Chilcot, Jr.
*Assistant Examiner*—Mark R Wendell
(74) *Attorney, Agent, or Firm*—Crowell Ing, LLP; Carl D. Crowell; Nye Wang

(57) ABSTRACT

A method for supporting manufactured home structures by preventing their deterioration and devaluation through the installation of a robust foundation system. The foundation system comprises of a concrete footing, long lasting wall panels and roof panels made from steel and cellular concrete. The manufactured home can be modified to accommodate the said installation. The wall panel is attached to both the manufactured home and foundation footing below the manufactured home to provide foundational supports for the manufactured walls of the manufactured home. Roofing panels can then be installed to the top of the manufactured home and newly installed wall panels for further protection. The benefits of this method allows the owner of the newly retrofitted or installed manufactured home to claim their home as real property instead of personal property thus allowing them qualify for long term mortgages.

19 Claims, 2 Drawing Sheets

STRUCTURAL SUPPORT FOR MANUFACTURED HOUSING TYPE STRUCTURES

CROSS REFERENCE TO RELATED APPLICATIONS

This application contains disclosure from and claims the benefit under Title 35, United States Code, §119(e) of the following U.S. Provisional Application: U.S. Provisional Application Ser. No. 60/821,896 Filed Aug. 9, 2006, entitled STRUCTURAL SUPPORT FOR MANUFACTURED HOUSING TYPE STRUCTURES.

BACKGROUND

This invention relates to a method of providing additional structural support to manufactured housing type structures, specifically to a method for providing a foundation and outside perimeter support to a manufactured housing type structures, strengthening the home against deterioration in an aesthetically pleasing manner while mitigating construction related causes for deteriorating property values.

Manufactured homes started as trailer homes. Trailers were built using the efficiency of a factory assembly line and thus were able to provide low cost housing. Once purchased, the dealer would deliver the trailer to a selected trailer park and set up the trailer for long-term use by removing the wheels and connecting utility lines. Thus, a single trailer could provide a low cost housing option.

Demand for larger spaces led to the manufacture of trailers in 2 or 3 individual pieces. In this way, the individual pieces were small enough to be delivered by semi trucks on ordinary roadways, but could be assembled later to form a residence much larger than a single trailer. These multi-part trailers, also known as double wides, could be larger than site built homes and thus were called mobile homes, and are now known as manufactured homes.

Manufactured housing continues to be the lowest cost new housing in the United States despite significant improvements in product quality and manufacturing. For example, walls in manufactured homes have changed from panel boards to stud and drywall construction. In addition, insulation, heating, and cooling systems are more efficient, comfortable, and reliable. However, in the face of these notable advances, manufactured homes are still assigned a personal property financing status and thus do not enjoy the appreciating appraisal values given to site built properties. In addition, manufactured homes do not qualify for 30 year mortgages and the mortgages they do qualify for have higher interest rates because of their unsuitability as long term collateral.

This unfavorable financing status is due to construction inadequacies which cause manufactured homes to deteriorate. Manufactured homes do not meet the requirements of typical residential building codes and thus are often not considered permanent construction. The siding and roofing materials are generally lighter and do not stand up to the elements as well as site built homes. Also, the flatter pitch roof, which is necessary for shipping purposes, can contribute to leaks and the formation of destructive ice dams. Because these homes are generally lighter and typically not set on foundations, they tend to move with wind and snow loads or internal loads. This movement causes deterioration. Without a foundation, a manufactured home's structure is even subject to deterioration from structural flexing caused by simple foot traffic or moving furniture. As such, the typical manufactured home is not a safe shelter in high winds and tornadoes.

In lieu of a foundation, a manufactured home can be anchored to the ground by screw-in anchor points or other methods to anchor the manufactured home to the ground to help secure and stabilize the manufactured home in high winds, tornadoes or during earthquakes. However, despite anchoring, various internal and external weather loads continue to cause the lightweight materials to move and flex resulting in further deterioration and devaluation. The problem is the anchoring support systems only address the flooring/bottom of the manufactured home, but ignores the need to support the exterior walls and roofing. High winds or tornados can rip or weaken the exterior walls regardless of whether the flooring is secured.

In cold climates, skirting with insulation and heater tapes around the base of a manufactured home is required to retain heat and prevent pipes from freezing. These skirtings are often made of low quality aluminum siding or other thin material that are neither durable nor aesthetically pleasing. Improper installation of heater tapes can cause a fire hazard when fuel pipes freeze and crack. In very cold climates, skirting alone is inadequate and unsightly bails of hay or straw must be piled up around the home's perimeter for additional insulation. Skirting also provides no structural support for the manufactured home and can seem an appealing shelter to small animals, and insects. The prior arts attempts to solve the said skirting problem with cement skirting that can be attached to the outer edge of the manufactured home to add both support and provide a more durable alternative. However, the prior arts still failed to address the support issue of the exterior walls.

The prior art has addressed the idea of building an enclosure around manufactured homes, thus adding to its stability and present the possibility of converting the structure into real property. However, the prior art's methods are overly extravagant and time consuming. In essence the prior arts hybrid homes and mobile enclosures require significant onsite work that defeats the low cost benefit of manufactured homes. Furthermore the prior arts methods expand significantly from the manufactured home and can be a problem for situations where room is limited.

What is herein desired and disclosed is a method of providing stability to manufactured home structures by supporting an existing manufactured home structures with a robust foundation and perimeter supports. The specific novelty of this invention mitigates construction related inadequacies in manufactured homes which cause deterioration and depreciation. The method herein is neither time nor labor intensive and facilitates an inexpensive alternative to the prior arts. What results is a type of manufactured home of sufficient structure to qualify for a typical 30 year mortgage because it will appreciate, rather than depreciate, in value.

SUMMARY OF THE INVENTION

The subject of this invention is a method of supporting manufactured home structures by providing a perimeter support structure around a manufactured home component with a number of external onsite installed wall panels anchored to the provided foundation. Roof panels or the construction of a typical roof structure can then be attached to the wall panels. The manufactured home's structure is connected to the wall panels and roof panels for additional support. The resulting structure is much stronger and will not deteriorate the way a traditional manufactured home does. In addition, the wall panels and roof are well insulated, eliminating the need for skirting and prevents roof leaks and ice dams while increasing the manufactured home's energy efficiency. The wall and roof panels can be pre-manufactured and pre-finished to reduce construction time and labor. The wall and roof panels are light weight and may be installed quickly without the need of a crane. The method of supporting manufactured home structures may be used on single and multiple story manufactured homes.

This invention mitigates or eliminates the structural problems associated with manufactured home structures by reinforcing a manufactured home's structure to prevent deterioration. This invention provides an inexpensive long term protection against hurricanes, fire, termites, and dry rot for manufactured homes that surpass typical site built homes. This structural support helps to qualify manufactured homes for 30 year mortgages because it prevents a manufactured home from becoming subject to depreciating personal financing status. Thus, the method of supporting a manufactured home allows a manufactured home to appreciate in value making it adequate collateral for long-term mortgages.

PREFERRED EMBODIMENT OF THE INVENTION

Figure 1:
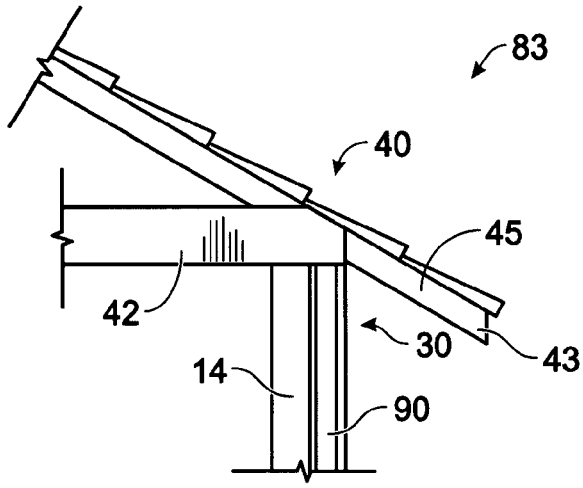
FIG. 1 is a cross section view of the roof and wall panels.
Figure 2:
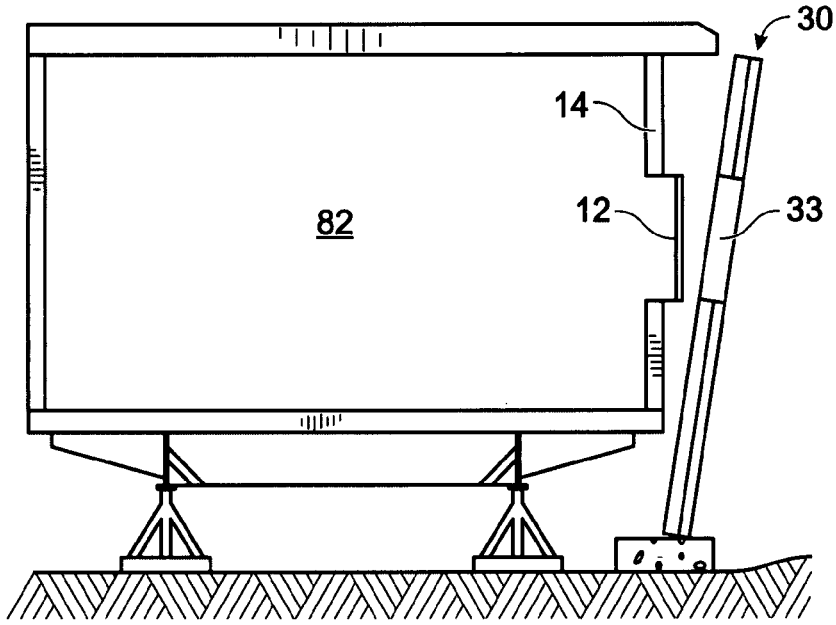
FIG. 2 is a cross section view of a wall panel installed and during installation.
Figure 3:
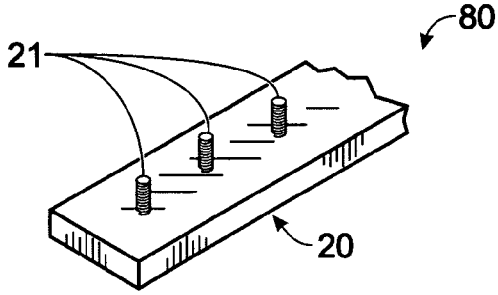
FIG. 3 is a perspective view of a footing.
Figure 4:
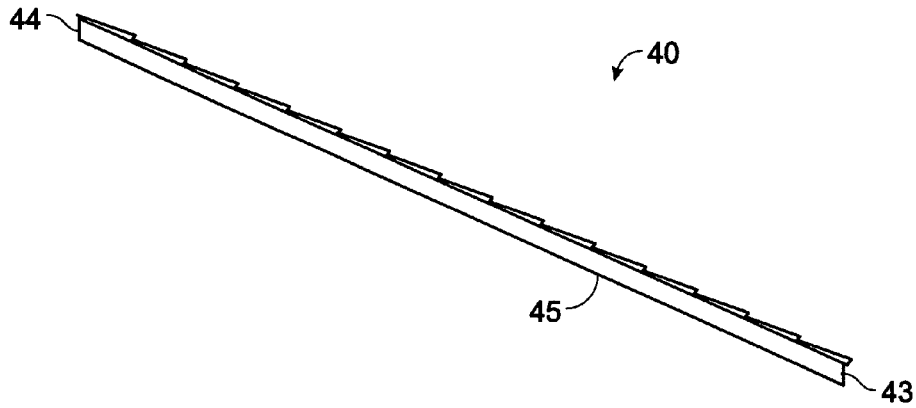
FIG. 4 is a cross section view of a roof panel.
Figure 5:
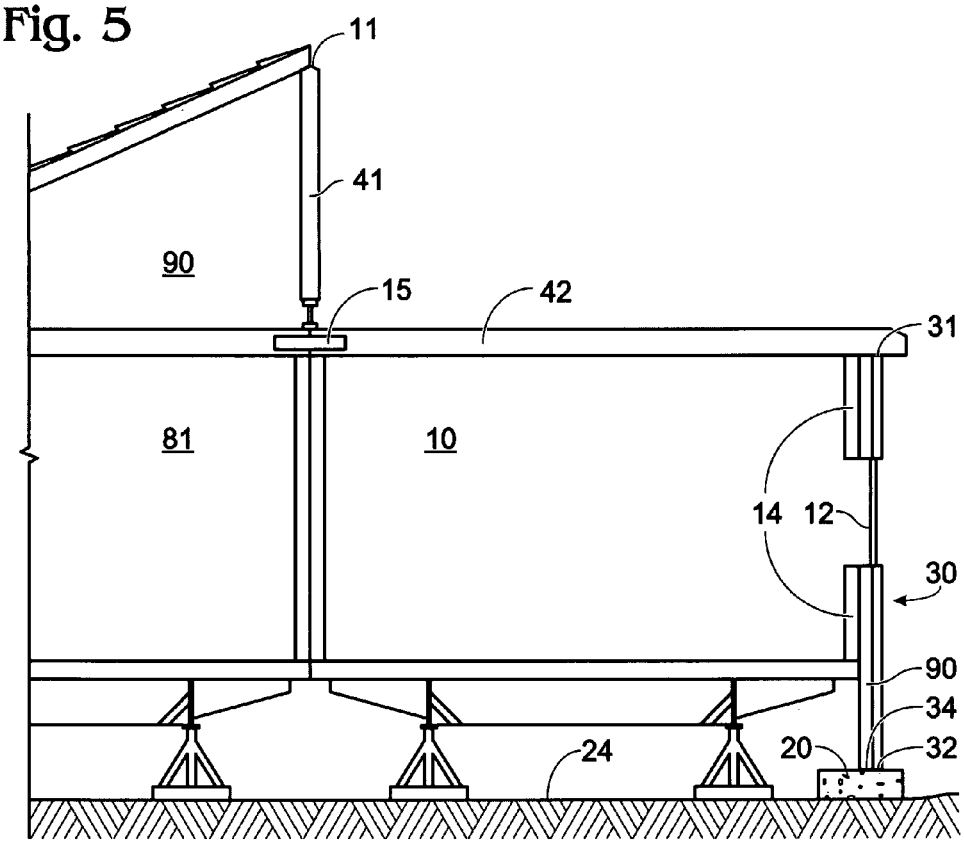
FIG. 5 is a cross section view of a manufactured home with structural support.

In the preferred embodiment, the method of upgrading or retrofitting manufactured home components begins by preparing an excavation site 80 where a manufactured home 10 will be installed. The perimeter of the excavation site 80 should be large enough to accommodate for the footing 20 later to be installed. Preparation is accomplished by installing a continuous footing 20 which is a foundation for the later installed wall panels 30. The footing 20 is made of concrete or like material and poured on site to meet local building codes for foundations. This footing 20 is placed along the perimeter of the manufactured home 10 and placed to allow the later installed wall panels 30 to be secured to the manufactured walls of the manufactured home 10.

Foundation bolts 21 are spaced along the length of the footing 20 to allow later onsite installation of wall panels 30. Wall panels 30 are external to the manufactured side and end walls 14 of the manufactured home 10. These foundation bolts 21 are inserted into the footing 20 so the threaded portion of each foundation bolt 21 protrudes from the top surface of the footing 20 to which it is inserted. The type of wall panel 30 being installed determines the amount of protrusion. In any case, the threaded portion of each foundation bolt 21 must protrude enough to allow the threaded portion to pass through the bottom plate 32 of a wall panel 30 with enough remaining length to be secured with a nut. Once the footing 20 is installed, a vapor barrier 24 is placed over any exposed ground under the manufactured home 10 to prevent destructive moisture seeping out of the ground from reaching the manufactured home 10.

Once preparing the site 80 is complete and the manufactured home 10 is delivered, manufactured home setup 81 can begin. The manufactured home 10 in this embodiment has steel ceiling joists 42 installed on outer topside of the manufactured home 10. The ceiling joists should extend beyond the side manufactured side and end wall 14 of manufactured home 10. If multiple manufactured homes are placed together, these ceiling joists can be attached by fasting plates 15 to bear roof tension load.

The window and door box openings 12 of the manufactured home should protrude out to accommodate the later installed wall panels 30. The extension of the windows 12 can be done by attaching a window to a plywood box or like material of desired depth and framing the plywood box to the exterior of the mobile home. The same steps can be taken to extend out the doors.

Once the manufactured home 10 is assembled, all necessary utility hook ups and code required blocking and anchors are installed. Once the manufactured home setup 81 is complete, wall installation 82 can begin.

In this embodiment the wall panels 30 are constructed of a thin panel of cellular concrete attached to lightweight steel beams with insulation 90 preinstalled and delivered to the site ready for installation. Due to the light weight nature of the cellular concrete wall panels, the lifting and installation of the panel does not require the use of a crane.

Each wall panel 30 has a top plate 31, and a bottom plate 32 which form the top and bottom of the wall panel 30. The bottom plate 32 has attachment holes 34 aligned with the foundation bolts 21, allowing the foundation bolts 21 to pass through during wall installation 82. The wall panels 30 are installed by setting the bottom plate 32 on top of the footings 20 with the foundation bolts 21 and attachment holes 34 aligned so the foundation bolts 21 may pass through the attachment holes 34. Once a wall panel 30 is properly set on its footing 20, the wall panel is then tilted up around the protruding windows and doors 12 and under the ceiling joists 42 so that wall panel 30 is flush against the manufactured wall 14 of manufactured home 10. Once the wall panel 30 is in place, nuts are installed on each foundation bolt 21 and tightened. These nuts secure the wall panels 30 to the footings 20. A plurality of screws can be used to secure the wall panels 30 to the manufactured home and to attach the top plate 31 of wall panel 30 to the steel ceiling joists 42.

The wall panels 30 have openings 33 that in the preferred embodiment have a clearance that substantially match the window and door box openings 12 of the manufactured home 10 to allow ingress and egress as well as maintain a view out of the manufactured home 10. After the wall panels 30 are secured, trim and an insulating sealer is applied to any gaps between the manufactured home 10 and the window and door openings 12 on the wall panels 30.

Once wall installation 82 is complete, roof installation 83 can begin. In this embodiment, the roof panels 40 are constructed of cellular concrete and delivered to the site ready for installation. Each roof panel has a lower edge 43, an upper edge 44 and spaced steel rafters 45. Steel stud bracing 41 may be installed under the manufactured home's 10 roof ridge 11 and attached to the steel ceiling joists 42 if the roof span so requires. A roof panel 40 can be installed by lining up the lower edge 43 of the roof panel 40 parallel to the top plate 31 of its corresponding wall panel 30 and then nesting the steel rafters 45 adjacent to the steel ceiling joists 42 and fastening the rafters and joist together. Then, the upper edge 44 can be attached to the roof ridge 11 using a steel track designed for the roof pitch. In this way, opposing roof panels 40 lean against each other over the roof ridge 11. The opposing roof panels 40 can then be fastened to each other. If necessary, vent holes corresponding to the manufactured home's 10 ceiling vents may be installed in the roof panels 40 to allow proper ventilation. Insulation 90 is used to insulate the attic space formed by installation of the roof panels 40 after the roof has been installed.

In another alternative embodiment the manufactured home 10 is delivered with an unfinished exterior. In this alternative embodiment the normal exterior siding and roofing of the manufactured home is not installed at the factory, thus relying on the wall panels 30 and roof panels 40 or site built roof for exterior protection. This allows further cost savings on the manufactured home 10 while maintaining the same advantage of the preferred embodiment.

In another alternative embodiment the above methods can be applied to a preexisting manufactured home.

In yet another alternative embodiment the wall panel 30 and roof panel 40 can be constructed on site.

In yet another alternative embodiment the method only involves installing the wall panels while using the preexisting roof of the manufactured home.

Throughout the specification the use of the term "wall panel(s)" refers only to the panels that are connected to the foundation and the manufactured home. The use of the term "roofing panel(s)" refers only to the panels used to provide additional roofing to the existing roof of the manufactured home.

Throughout the specification the aim has been to describe the invention without limiting the invention to any one embodiment or specific collection of features. Persons skilled in the relevant art may realize variations from the specific embodiment that will nonetheless fall within the scope of the invention. For example, the wall panels 30 and roofing 40 need not be pre manufactured but can be constructed on site. The materials of the wall panels and roofing need not be cellular concrete but can be standard concrete or any material known in the art. The wall panels can consist of decorative exterior to simulate the appearance of brick material or the likes.

Accordingly, the scope of the invention should be determined not by the embodiments illustrated, but by the appended claims and their legal equivalents.

I claim:

1. A method of supporting and protecting a manufactured home structure comprising the steps of:

a) providing a manufactured home with vertical manufactured side and end walls, an at least one door, and an at least one window;

b) setting up said manufactured home to accommodate a plurality of onsite exterior wall panels to stand exterior to, substantially flush, and parallel of said vertical manufactured side and end walls;

c) preparing said plurality of on site exterior wall panels to allow for openings to accommodate said an at least one corresponding door and an at least one corresponding window to said vertical manufactured side and end walls of said manufactured home;

d) preparing said plurality of onsite exterior wall panels with a means of attachment directly to a foundation;

e) preparing a site with the said foundation consisting of an anchor system and a footing structure placed along the perimeter of the manufactured home with a means of attachment;

f) attaching the said manufactured home to the said foundation using the said anchoring system;

g) attaching onsite the said plurality of onsite exterior wall panels directly to the said footing structure of the said foundation; and h) attaching the said plurality of onsite exterior wall panels to the said manufactured home, wherein the said plurality of onsite exterior wall panels are substantially flush against and substantially vertically enclose all of the said vertical [outer] manufactured side and end walls of the said mobile home.

2. The method of supporting said manufactured home structure of claim 1, wherein the said an at least one door and an at least one window protrudes out of said manufactured home.

3. The method of supporting said manufactured home structure of claim 1 further comprising the steps of:

a) providing an at least one ceiling joist on the outer topside of said manufactured home; and b) installing an at least one roof panel with an at least one roof rafter by attaching said roof rafter to said ceiling joists and said plurality of onsite exterior wall panels.

4. The method of supporting said manufactured home structure of claim 3, wherein said roof panel is comprised of a light weight cellular concrete material.

5. The method of supporting manufactured home structure of claim 3, wherein said roof panel is comprised of a concrete material.

6. The method of supporting manufactured home structure of claim 1, wherein the said plurality of onsite exterior wall panels contains an insulation layer.

7. The method of supporting said manufactured home structure of claim 6, wherein said manufactured home is delivered with an unfinished exterior wherein said plurality of onsite exterior wall panels and said roof panel acts as the exterior protection of said manufactured home.

8. The method of supporting manufactured home structure of claim 1, wherein said plurality of onsite exterior wall panels are comprised of a light weight cellular concrete material.

9. The method of supporting manufactured home structure of claim 1, wherein said plurality of onsite exterior wall panels are comprised of a concrete material.

10. The method of supporting said manufacture home structure of claim 1, wherein said plurality of onsite exterior wall panels are constructed of a light weight cellular concrete material and supported by an at least one light weight steel beam.

11. The method of supporting said manufactured home structure of claim 1, wherein said footing structure consist of a plurality of protruding foundation bolts and said plurality of protruding foundation bolts are bolted to a plurality of attachment holes located on the bottom of the said plurality of onsite exterior wall panels.

12. A structure, comprising:

a. a manufactured home comprising a plurality of vertical manufactured side and end walls, and horizontal top and bottom walls;

b. a plurality of onsite installed exterior wall panels wherein the said plurality of exterior wall panels-each contain a top plate and a bottom plate;

c. a foundation consisting an anchoring system connecting the said bottom wall to the said foundation and a footing structure placed along the perimeter of the manufactured home and attached to the said bottom plates of the said plurality of exterior wall panels;

d. the said bottom plates of the said plurality of exterior wall panels are attached to the top of the said footing structure, allowing said plurality of exterior wall panels to stand substantially flush and parallel to the said vertical manufactured side and end walls of the said manufactured home;

e. the said plurality of exterior wall panels accommodates for any windows and doors found on the said vertical manufactured side and end walls of the said manufactured home; and f. The said plurality of exterior wall panels are attached to the said vertical manufactured side and end walls to vertically enclose said manufactured side and end walls of the said manufactured home and substantially covers all exposed and unfinished areas of the said vertical manufactured side and end walls of the said manufactured home.

13. The structure of claim 12 wherein the said plurality of exterior wall panels includes an insulation layer.

14. The structure of claim 13 wherein the said plurality of exterior wall panels are comprised of a concrete material.

15. The structure of claim 13 wherein the said plurality of exterior wall panels are comprised of a cellular concrete material.

16. The structure of claim 12 further comprising a plurality of roofing panels attached to the said plurality of exterior wall panels and the said manufactured home, whereby fully enclosing the said manufactured home.

17. The structure of claim 16 wherein the said plurality of roofing panels are comprised of a concrete material.

18. The structure of claim 16 wherein the said plurality of roofing panels are comprised of a cellular concrete material.

19. The structure of claim 12 wherein the said manufactured homes has an at least one protruding door and an at least one protruding window.

* * * * *